US005193852A

United States Patent [19]

Bachmeyer

[11] Patent Number: 5,193,852

[45] Date of Patent: Mar. 16, 1993

[54] CARD OR SHEET FOLDED COVER

[75] Inventor: Stanley R. Bachmeyer, Traverse City, Mich.

[73] Assignee: Score Caddy, Inc., Traverse City, Mich.

[21] Appl. No.: 918,707

[22] Filed: Jul. 27, 1992

[51] Int. Cl.[5] ..... B42D 1/00

[52] U.S. Cl. ..... 281/15.1; 281/31; 281/45; 229/1.5 R; 40/642

[58] Field of Search ..... 281/31, 45, 15.1; 40/642, 649; 229/1.5 R, 72

[56] References Cited

U.S. PATENT DOCUMENTS 3,954,287 5/1976 Osteen ..... 281/15 R 4,204,704 5/1980 Staats ..... 281/21 R

FOREIGN PATENT DOCUMENTS 719232 12/1951 United Kingdom .

*Primary Examiner*—Mark Rosenbaum

*Assistant Examiner*—Kenneth J. Hansen

*Attorney, Agent, or Firm*—Watson, Cole, Grindle & Watson

[57] ABSTRACT

A card or sheet cover has a center fold defining a first foldline dividing the cover into front and back panels. The front panel has a section formed by a second foldline parallel to and spaced from the first foldline, such section overlying a corresponding section of the back panel such that the front and back panel sections together define a portion of the cover capable of being grasped for attaching the cover to a support while permitting the front panel, outside its second foldline, to be flipped open to gain access to the underlying card or sheet which is retained on the inner surface of the back panel by a shallow pocket or the like.

5 Claims, 1 Drawing Sheet

CARD OR SHEET FOLDED COVER

BACKGROUND OF THE INVENTION

This invention relates generally to a cover for a card or sheet, more particularly to a cover of water repellent material for a golf scorecard capable of being attached to the steering wheel hub of a golf cart in the manner permitting free access to the scorecard while also protecting the card against rain and wind elements.

The cover according to the invention is generally of a double hinge construction. It facilitates attachment of the cover to its support while permitting opening and closing of the front cover over the card without interference.

The present invention is especially useful as a folded cover for a golf scorecard which is typically attached to a flat writing surface at the hub of the steering wheel of a motorized golf cart. The scorecard is normally attached in place using a standard spring clip mounted on the writing surface. The card bears typical score blocks and indicia listing the hole yards, par and handicap for both men and ladies. Typically such indicia is printed on one side for the front nine holes and is repeated on the reverse side for the back nine holes. A margin is normally maintained along the top or side of the card outside the score blocks to permit the card to be attached by the spring clip to its writing surface without interfering with the score blocks.

The card typically remains attached in place during the front nine holes and is then flipped over for entering the scores for the back nine holes, and remains clipped in place throughout the entire golf game. In the event of rain or drizzle or gusty winds, the scorecard becomes damp or wet presenting not only a nuisance but interfering with the player's ability to maintain an accurate record of his/her score. Also, if the card tears or is blown away by the wind the golf game can be seriously impeded.

Double hinge structures of the aforedescribed type have been devised although such structures are typically designed as a sheet holder or book binder requiring fastening means for securing the sheets in place within the holder or binder as required for such particular use. The fastening means typically engages a margin of the stacked sheets thereby precluding use of the holder or binder as a folded cover for a card or sheet as in the invention.

SUMMARY OF THE INVENTION

It is therefore an object of the present invention to provide a cover of dual hinge construction for the protection of a card or sheet while in use and permitting easy an unobstructed access to the card or sheet when desired.

The cover has a center fold defining a first foldline and has a second foldline in the front panel parallel to and spaced from the first foldline such that, when the front panel is folded over the back panel on which the card or sheet is supported, the section of the front panel between the foldlines and the underlying section of the back panel located outside the area of the cover card together define a portion of the cover which can be grasped as by a spring clip for attaching the cover to a support while permitting the front panel outside its second foldline to be hinged open to access the card.

Means provided on the back panel for supporting the card thereon may be in the form of a shallow pocket located along one of the free edges of the back panel for the reception of the card along an end or side edge thereof.

The cover may be of water repellent material such as of sheet of molded plastic, and the pocket may be of a strip of transparent plastic material having a width substantially less than that of the length or width of the card.

Other objects, advantages and novel features of the invention will become more apparent from the following detailed description of the invention when taken in conjunction with the accompanying drawings.

DETAILED DESCRIPTION OF THE INVENTION

Figure 1:
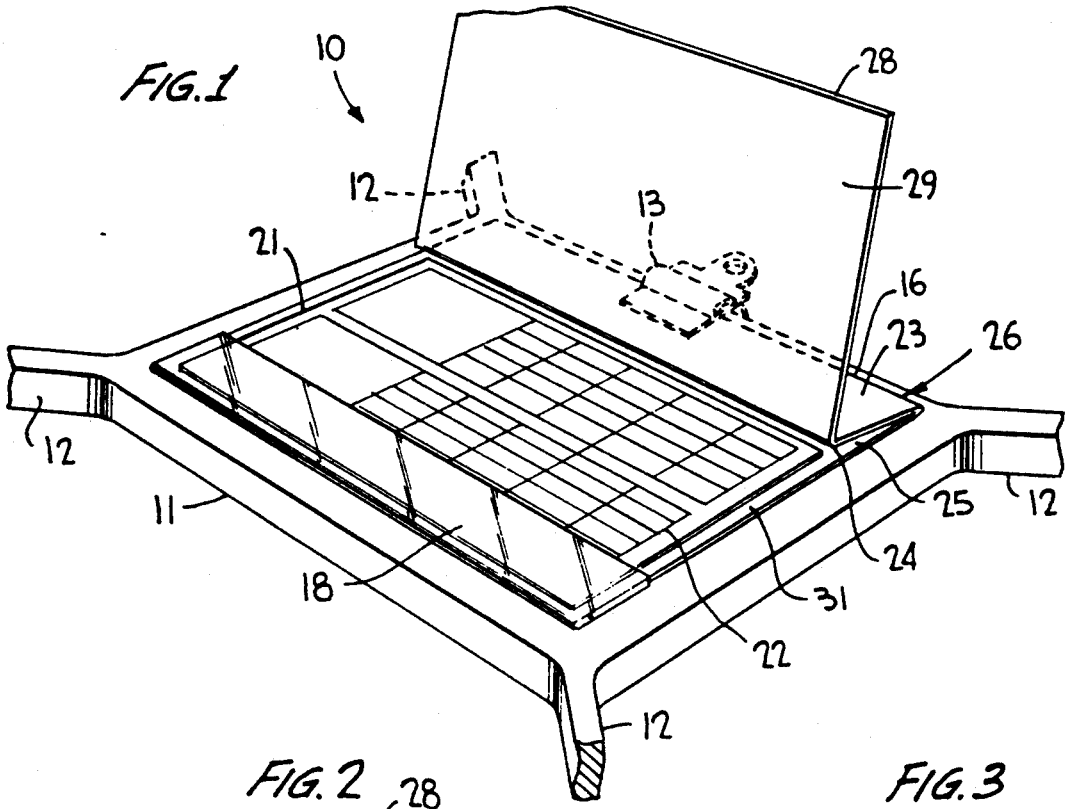
FIG. 1 is a perspective view of the cover according to the invention showing the cover spring clipped in place on a support with the front panel hinged open to access the underlying card.

Turning now to the drawings wherein like reference characters refer to like and corresponding parts throughout the several views, the folded cover 10 according to the invention is shown in FIG. 1 attached to a writing support surface 11 which typically overlies the steering column of a motorized golf cart (not shown) and is located at the center of the cart steering wheel (not shown) as connected thereto by the steering wheel spokes 12. A standard spring clip 13 mounted on support 11 in some typical fashion is utilized for attaching the folded cover to the support in a manner to be described in more detail hereinafter.

Figure 2:
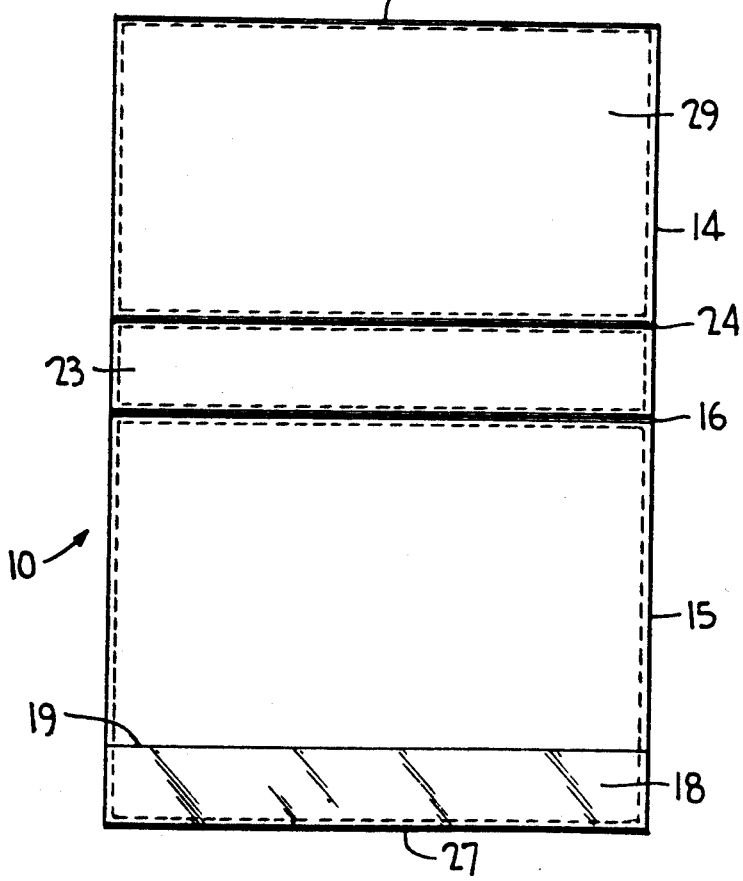
FIG. 2 is a top plan view of the unfolded cover of FIG. 1.
Figure 3:
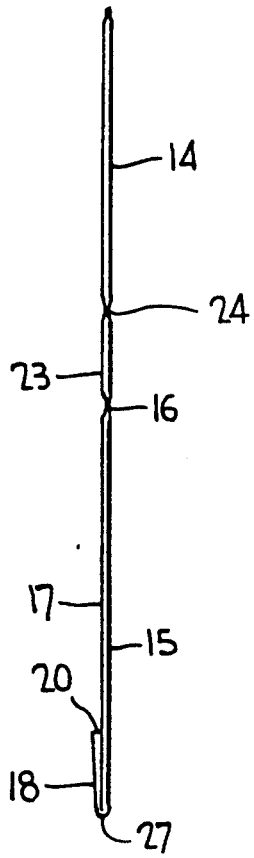
FIG. 3 is typical end view of the FIG. 2 cover.

As shown in detail in FIGS. 2 and 3, cover 10 is formed of a rectangular layer having front and back panels 14 and 15 which are interconnected along a center fold of the cover defining a first foldline 16 bisecting the layer and about which the front panel can be folded to completely overlie inner surface 17 of the back panel.

A card retainer is provided on the back panel inner surface and may be in the form of a narrow strip 18 of clear plastic material or the like secured along three edges thereof to corresponding edges of the back panel to thereby form an open pocket 20 along free edge 19. Strip 18 is sufficiently narrow in width so that when a card 21 is inserted along its bottom edge, the score blocks 22 printed thereon are fully accessible outside the pocket to receive score markings during play of the game.

Of course, the card retaining pocket could be provided along either end edge of the back panel, or some other type of card retainer could be provided within the scope of the invention, so long as the score blocks remain exposed while the card is retained in place.

Front panel 14 has a section 23 formed by a second foldline 24 lying parallel to and spaced from first foldline 16.

Cover 10 may be of a rigid plastic material which renders it water repellent, and foldlines 16 and 24 may be formed by creases located on the opposing side faces of the cover (see FIG. 3) such as by a hot stamping process.

When the front panel is folded over the back panel, section 23 of the front panel overlies a corresponding section 25 of the back panel, such that sections 23 and 25 together define a Portion 26 of the cover which is grasped as by spring clip 13 for attaching the cover to support 11, as shown in FIG. 1. In this position, the scorecard 21 is retained on inner surface 17 of the back panel partially within pocket 20, and the scorecard is completely exposed to view as front panel section 29, defined between upper side edge 28 and foldline 24, is hinged upwardly about second foldline 24. Thus, the width of the scorecard is less than the distance between second foldline 24 and lower side edge 27 of the cover, when viewed in the assembled condition of FIG. 1. Stated otherwise, the card is retained on a section 31 of the back panel which extends between foldline 24 and edge 27, the card having a width slightly less than section 31.

And, when the front panel is folded over the back panel, side edges 27 and 28 thereof are coincident by reason of the interconnection of the front and back panels along the cover center fold which is defined by line 16.

In use, the player simply inserts the lower edge of the scorecard within pocket 20 and folds the front panel 14 along foldline 16 over the card. Portion 26 of the cover is inserted within spring clip 13 as normally located on support 11 at the hub section of the cart steering wheel. The remaining section or flap 29 of the front panel may be simply hinged upwardly about its foldline 24 to gain complete access to the scorecard, as shown in FIG. 1. Since the scorecard is not retained in place by the spring clip 13, nor is the card sandwiched between overlying sections 23 and 25 of the cover, the card can be removed and flipped over to record the back nine golf scores while the cover remains attached to support 11. At the end of the game, the cover is simply removed from the wheel hub.

Since the card is not retained in place by the spring clip, it can have a narrower dimension without the need for a top section outside the score blocks which is normally required to avoid interference with the score blocks by the spring clip. Thus, the card can be produced more economically.

Moreover, the card cover according to the invention shelters the scorecard against rain or drizzle or high winds during play of the game thus avoiding card loss and damage when subjected to the weather elements.

And, the card or sheet cover according to the invention has other utility as it is, for example, capable of being attached to a standard clipboard when used outdoors by a surveyor, architect, engineer, construction foreman, or the like. Thus, the writing sheet or pad provided during such use is protected against the weather elements while on the job, yet is readily accessible by simply flipping open section 29 of the front panel as in the manner aforedescribed.

Obviously, many other modification and variations of the present invention are made possible in the light of the above teachings. It is therefore to be understood that within the scope of the appended claims the invention may be practiced otherwise than as specifically described.

What is claimed is:

1. A cover for protecting and holding a card or sheet having upper and lower opposed side edges, comprising, a rectangular layer of material having opposed upper and lower side edges, said layer having a first foldline bisecting said layer to form front and back rectangular panels of equal size, said foldline lying parallel to said side edges of said layer to permit said layer to be folded so that said front panel overlies said back panel with said opposed side edges of said layer being coincident, only said back panel having a card or sheet holding means for holding a cover or sheet only on a first section of said back panel, said layer having a second foldline lying parallel to and spaced from said fist foldline and defining a front panel section between said foldlines, said front panel between said second foldline and said upper edge of said layer defining a front panel flap hinged to said front panel section, said second foldline being spaced a predetermined distance from said upper side edge which is greater than a spacing from said first foldlines, said front panel section overlying a second section of said back panel located adjacent said first section of said back panel, said front panel section and said second section of said back panel together defining an overlying portion of said layer to be grasped for attaching the cover to a support.

2. The cover according to claim 1, wherein said holding means comprises a pocket extending along said lower side edge of said layer for the reception of a portion of the card or sheet.

3. The cover according to claim 2, wherein said pocket comprises a strip of transparent plastic material, said strip having a width substantially less than that of said first section.

4. The cover according to claim 1, wherein said layer is of water repellant material of a predetermined thickness.

5. The cover according to claim 4, wherein said first and second foldlines are defined by creases in said layer of a thickness less than said predetermined thickness.

* * * * *